United States Patent [19]

Vittoria

[11] Patent Number: 4,590,448

[45] Date of Patent: May 20, 1986

[54] TUNABLE MICROWAVE FILTERS UTILIZING A SLOTTED LINE CIRCUIT

[75] Inventor: Carmine Vittoria, Newton, Mass.

[73] Assignee: The United States of America as represented by the Secretary of the Navy, Washington, D.C.

[21] Appl. No.: 780,068

[22] Filed: Sep. 25, 1985

[51] Int. Cl.[4] ..... H01P 1/203; H01P 1/215

[52] U.S. Cl. ..... 333/205; 333/223; 333/246

[58] Field of Search ..... 333/24.1, 24.2, 202, 333/204, 205, 246, 219, 222, 223, 235, 1.1; 334/41

[56] References Cited

U.S. PATENT DOCUMENTS

| | | | |
|---|---|---|---|
| 3,546,637 | 12/1970 | Wen | 333/205 |
| 3,560,893 | 2/1971 | Wen | 333/204 X |
| 3,681,716 | 8/1972 | Chiron et al. | 333/205 |
| 3,715,692 | 2/1973 | Reuss, Jr. | 333/24.1 |
| 3,753,167 | 8/1973 | Cohn | 333/202 |
| 4,297,661 | 10/1981 | Stegens | 333/204 |
| 4,319,208 | 3/1982 | de Bayser et al. | 333/204 |
| 4,521,753 | 6/1985 | Schloemann | 333/204 |

*Primary Examiner*—Marvin L. Nussbaum
*Attorney, Agent, or Firm*—Robert F. Beers; Sol Sheinbein

[57] ABSTRACT

A slotted line tunable microwave filter of the type having a metallic layer having slot patterns thereon, and an insulating layer, the filter also including a variable bias D.C. magnetic field source, for imposing a magnetic field on a dielectric junction in the metallic layer, which may be varied to tune the filter resonant frequency.

In one embodiment of the invention the slot pattern comprises a first set of slots and a second set of slots.

The first set of slots comprises a first slot disposed coincident with a negative x axis and the second set of slots comprises a second slot disposed coincident with a positive x axis.

15 Claims, 2 Drawing Figures

TUNABLE MICROWAVE FILTERS UTILIZING A SLOTTED LINE CIRCUIT

BACKGROUND OF THE INVENTION

The present invention relates to improved magnetically tunable filters, and more particularly to planar slotline microwave filters.

Besides the obvious use as bandpass or bandstop filters, microwave filters have been used in the field of medicine to study the characteristics of bodily parts which are comprised of mostly aqueous solutions. Recently, there has been considerable interest in characterizing or identifying defective human heart cells using microwave techniques. A standard microwave technique which is often used for this and similar research in medicine is the Electron Paramagnetic Resonance Technique EPR. EPR attempts to use resonant cavities have proven ineffective for a variety of reasons. For example, the aqueous nature of the heart cell causes near total absorption of the microwave energy in the cavity. Hence, the cavity fails to resonate and a biological analysis of the microwave data cannot be made. Additionally, due to the necessity for the cavity to operate at one resonant frequency, response characteristics over a wide frequency range cannot be obtained. Much more useful information can be deduced, if microwave experiments can be performed over a wide frequency range.

Tunable band pass filters are known in which an input path and an output path are coupled by bulk ferri- or ferro-magnetic material. The tuning of the filter resonant frequency is achieved by applying a variable dc magnetic field to spherical ferri- or ferro-magnetic material. Such known filters are complicated and expensive to make, and while passing the signals of the pass band frequencies with little attenuation these filters often lack isolation between the input and output paths at frequencies other than the pass band of the filter. With the advent of the semiconductor chip, the microwave technology has shifted toward planar microwave circuitry. Accordingly, it is desirable to have a planar microwave filter wich can be fabricated using presently known semiconductor technology.

OBJECTS OF THE INVENTION

Accordingly, it is an object of the present invention to provide an improved microwave filter capable of operating over a wide frequency range.

It is a further object of the present invention to provide a microwave filter which is easily fabricated using semiconductor technology.

It is still a further object of the present invention to provide a microwave testing technique to measure the response characteristics of lossy (aqueous) biological parts.

Other objects, advantages, and novel features of the present invention will become apparent from the detailed description of the invention, which follows the summary.

SUMMARY OF THE INVENTION

Briefly, the above and other objects are realized by a microwave filter device comprising a base layer of low-loss insulating material and a conductive magnetic material layer having a magnetic susceptibility value high enough to be classified as ferromagnetic disposed on the base layer. The conductive magnetic material layer has a first, second, third and fourth side, a top surface, a positive x axis and a parallel negative x axis intersecting at an origin. The x axes divide the top surface into halfs. The x axes run parallel to the first and third sides. The conductive magnetic layer also has a y axis perpendicular to said x axes and intersecting therewith at the origin. A pattern of slots are formed in the conductive magnetic material layer. The pattern comprises a first set of slots and a second set of slots. The first set of slots extends parallel to the negative x axis. The first set of slots only extend up to but do not touch the y axis. The second set of slots extends parallel to the positive x axis. The second set of slots only extend up to but do not touch the y axis. The first and second sets of slots are symmetrical about the x axes.

A dielectric junction is formed at the origin of the negative and positive x axes.

First and second electrical connectors are disposed opposite each other along the x axes of the conductive magnetic material layer for coupling electromagnetic energy to and from the conductive magnetic material layer.

A variable dc magnetic field source is disposed along the first and third sides of the conductive magnetic material layer to pass a frequency across the plane of the junction to tune a resonant frequency.

In one embodiment a metal layer is disposed on the ferrite base layer.

In another embodiment of the present invention the first set of slots comprises a first slot disposed coincident with the negative x axis and the second set of slots comprises a second slot disposed coincident with the positive x axis.

In a preferred embodiment of the present invention the first set of slots comprises a first slot disposed coincident with the negative x axis and the second set of slots comprises first and second slots disposed symmetrically, one on each side of the positive x axis. The preferred embodiment also includes a y axis slot disposed parallel to and coincident with the y axis.

DETAILED DESCRIPTION OF THE PREFERRED EMBODIMENT

The present invention is based on the fact that although microwave coupling does not exist across the dielectric junction of a waveguide, coupling can be induced by the application of an d.c. magnetic field. Due to the non-reciprocal properties of ferrite elements coupling can be established at a resonant frequency tuned by an externally applied magnetic field.

Figure 1:
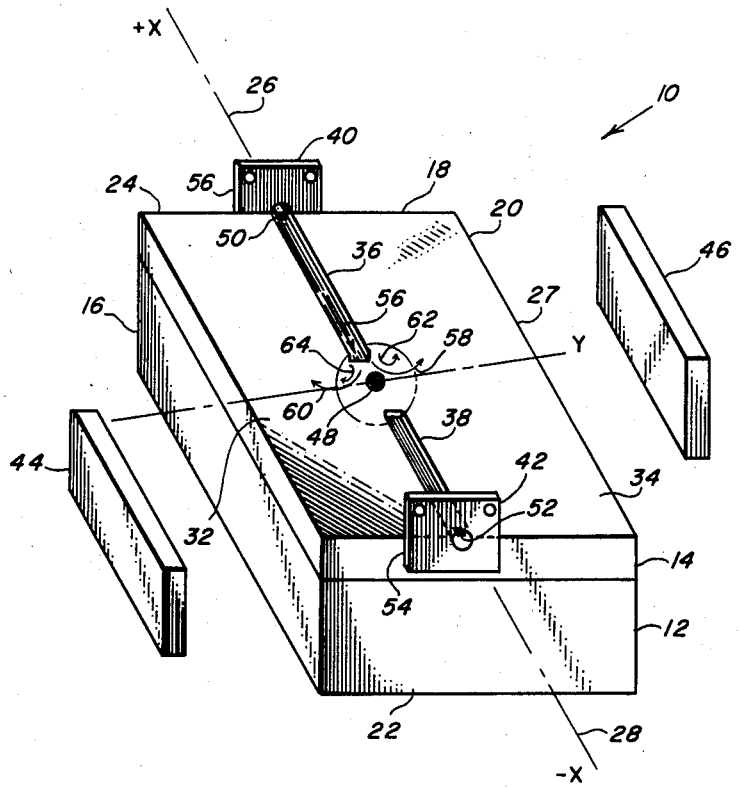
FIG. 1 is a schematic diagram of one embodiment of the present waveguide filter.

Referring now to the drawings, wherein like reference characters designate like or corresponding parts throughout the views, FIG. 1 shows one embodiment of the present invention. The tunable slotline microwave filter 10 of the present invention 10 comprises a base layer 12 of low-loss insulating material and a conductive magnetic material layer 14 having a magnetic susceptibility value high enough to be classified as ferromagnetic disposed on the base layer 12. The conductive magnetic material layer 14 has a first side 16, a second side 18, a third side 20 and a fourth side 22, a top surface 24, a positive x axis 26 and a parallel negative x axis 28 intersecting therewith at an origin 30. The x axes 26, 28 divide the top surface 24 into halfs 32, 34. The x axes 26, 28 run parallel to the first side 16 and third side 20.

The conductive magnetic material layer 14 also has a y axis 27 perpendicular to the x axes 26, 28 and intersecting therewith at the origin 30. A pattern of slots are formed in the conductive magnetic material layer 14. The pattern comprises a first set of slots and a second set of slots.

The first set of slots extend parallel to the negative x axis 28 and extend up to but do not touch the y axis 27. The second set of slots extend parallel to the positive x axis 26 and extend up to but do not touch the y axis 27. The first and second sets of slots are symmetrical about the x axes 26 and 28. A dielectric junction 48 is formed at the origin 30 of the negative and positive x axes. First and second electrical connectors 40 and 42 are disposed opposite each other along the x axes 26, 28 of the conductive magnetic material layer 14 for coupling electromagnetic energy to and from the conductive magnetic material layer 14.

A variable dc magnetic field source 44, 46 is disposed along the first side 16 and third side 20 of the conductive magnetic material layer 14 to pass a frequency across the plane of the junction to tune a resonant frequency.

The base layer 12 of low-loss insulating material may take a variety of forms. However, in a preferred embodiment, a dielectric material is used. Dielectrics such as bakelite, glass and GaAs provide an excellent low-loss insulating base for the filter 10.

The conductive magnetic material layer 14 disposed on the base layer 12 may also take a variety of forms. However, when the base layer 12 is a dielectric material such as bakelite, the magnetic material layer 14 may conveniently take the form of a magnetic material such as MBE iron, nickel, cobalt and iron films. These materials all have a high enough value of magnetic susceptibility to be classed as ferromagnetic.

The pattern of slots formed in the surface of the magnetic material layer may take a variety of patterns. The shape and number of slots depends on the desired input and output path and also the slots can affect the characteristic impedance of the filter 10. The slots serve to constrain or guide the propagation of microwaves along a path defined by their physical construction. In FIG. 1 the slot pattern comprises first and second slots 36, 38. The first slot 36 extends parallel and coincident to the positive x axis 26. The first slot 26 extends up to but does not touch the y axis 27 established on the top surface 24 of the conductive magnetic material layer 14. The second slot 38 extends parallel and coincident to the negative x axis 28. The second slot 38 extends up to but does not touch the y axis 27 established on the top surface 24 of the conductive magnetic material layer 14. Slots 36, 38 may be conveniently formed in the conductive magnetic material layer 14 by photoetching.

The first and second electrical connectors 40, 42 are disposed opposite each other along the x axes 26, 28 of the magnetic material layer for coupling electromagnetic energy to and from the magnetic material layer 14. In the embodiment of FIG. 1 OSM adapters (special adapters manufactured by OMNI SPECTRA, Inc. of Michigan) are used.

The first connector 40 is to be mounted on one side 18 of the filter 10 along the positive x axis 26 of slot 36. The second connector 42 is similarly mounted to side 22 along the negative x axis 28.

The OSM connectors 40 and 42 are bidirectional and either one may serve as the input or output terminal. Each adapter is electrically connected such that its center pin 50, 52 connects with the conductive magnetic material layer and the outer surface 54, 56 is connected to the substrate 12 or ground.

The variable dc magnetic field source may be applied from a variety of sources. It is conveniently shown in FIG. 1 applied by two orthogonal Hemholtz coils 44, 46 disposed along opposite sides 16, 20 of the filter 10.

With the Helmholtz coils 44, 46 positioned orthogonal to each other, it is possible to apply a variable dc magnetic field at any direction in the plane of junction area 30 by rotating the magnetic field through small angles. By rotation of the magnetic field in the plane of the junction, a large center frequency tuning range can be achieved. The magnetic field may be rotated by varying the current applied to the Helmholtz coils 44, 46.

In operation, when microwave energy is applied to either of the slotlines 36, 38 through the OSM adapters 40, 42 and the dc biasing magnetic field is applied to the plane of the junction area 30, only signals, in the form of induced current, within a predetermined frequency range will pass through the junction and be coupled from one slotline 36 or 38 to the other 36 or 38.

Electromagnetic coupling occurs only when the magnetic layer 14 is magnetically "active", that is resonant. The magnetic layer 14 is resonant only at a given frequency which depends on the intensity and field direction of the magnetic field. The resonant frequency generally varies according to the equation $$f=\gamma H. \quad (1)$$

where f is the resonant frequency, $\gamma=2.8$ MHz/Oe, and H is the field strenth of the applied field in oersted.

At the junction area 30 the induced current 56 splits evenly to the left 58 and to the right 60 of the junction area. By applying the right hand rule to the induced current flow 56, it can be shown that the induced magnetic fields 62, 64 are circularly polarized but in an opposite sense of rotation relative to each other. The induced currents across the junction cancel each other out, since the two induced currents flow over the junction opposite each other. The magnetic layer 14 is magnetically active only with that magnetic field line which contains the proper sense of circular polarization. At resonant frequency, the magnetic sample interacts with one circularly polarized magnetic field but not with the other. This means that the two induced circularly polarized magnetic fields are unequal, because they interact differentlly with the magnetic material. This means that the induced currents across the junction no longer cancel each other. Hence, we have an unbalanced junction and coupling across the junction area 30 occurs.

The present device has been disclosed with a base layer of low-loss insulating material, a conductive magnetic material layer disposed on the base layer and slot patterns etched in the magnetic material layer. However, the device will work equally well, according to the same principles, if a metal layer of, for example, copper is disposed on a ferrite base layer. Suggested ferrites include spinel, garnet and hexagonal ferrite. The slot pattern would be formed in the metal layer.

Figure 2:
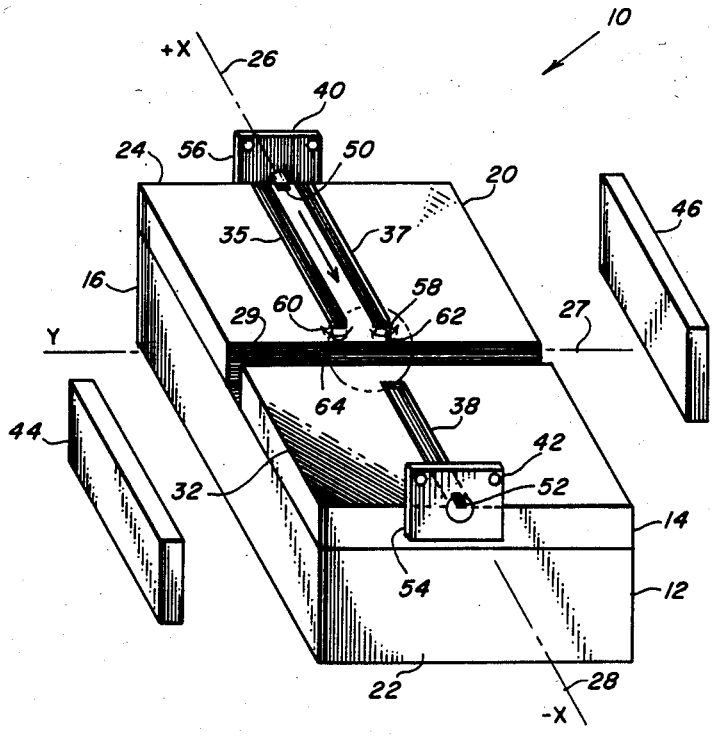
FIG. 2 is a schematic diagram of a preferred embodiment of the present invention.

A preferred tunable slotline microwave filter is shown in FIG. 2. In a preferred embodiment of the present invention the first set of slots comprise a first slot 38 disposed coincident with the negative x axis 28 and the second set of slots comprise a first slot 35 and a second slot 37 disposed symmetrically, one on each side of the positive x axis 26. The preferred embodiment also includes a y axis slot 29 disposed parallel to and coincident with the y axis 27.

If a biological specimen is to be tested, it is placed over the junction area 30. The DC magnetic field is fixed at some value, H. Maximum transmission will occur at frequency of f, where $f=\gamma H$ and $\gamma=2.8$ MHz/Oe. By varying H it is possible to test a specimen over a wide range of frequencies. The functional relationship between f and H as established by this experiment characterizes the biological specimen.

The magnetically tunable bandpass filter made in accordance with the teaching of this invention is easy to fabricate since the elements are planar. The operating frequency may be easily controlled by use of the varying magnetic field and may be tuned over a large range with very fast electronic switch times.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A tunable slotline microwave filter comprising:

a base layer of low-loss insulating material;

a conductive magnetic material layer having a magnetic susceptibility value high enough to be classified as ferromagnetic disposed on the base layer, said conductive layer having first, second, third and fourth sides, a top surface, a positive x axis and a parallel negative x axis intersecting at an origin and dividing the top surface into halfs, said x axes running parallel to said first and third sides, and a y axis perpendicular to said x axes and intersecting therewith at said origin;

a pattern of slots formed in said conductive magnetic material layer comprising a first set of slots and a second set of slots, with said first set of slots extending parallel to said negative x axis and only extending up to but not touching said y axis, with said second set of slots extending parallel to said positive x axis and only extending up to but not touching said y axis, and with said first and second sets of slots being symmetric about said x axes;

a dielectric junction formed at the origin of the negative and positive x axes;

first and second electrical connectors disposed opposite each other along the x axes of the conductive magnetic material layer; and means for applying a variable dc magnetic field along the surface of the conductive magnetic material layer at different desired angles, said applying means being disposed along the first and third sides of the conductive magnetic material layer to tune a resonant frequency.

2. A slotline microwave filter as defined in claim 1, wherein said means for applying a variable d.c. magnetic field along the surface of said magnetic material layer at different desired angles is a pair of orthogonal Helmholtz coils.

3. A slotline microwave filter as defined in claim 1, wherein the conductive magnetic material is chosen from the group consisting of MBE iron, iron films, nickel and cobalt.

4. A slotline microwave filter as defined in claim 3, wherein said first set of slots comprises a first slot disposed coincident with said negative x axis.

5. A slotline microwave filter as defined in claim 4, wherein said second set of slots comprises a second slot disposed coincident with said positive x axis.

6. A slotline microwave filter as defined in claim 4, wherein said second set of slots comprises a first and second slots disposed symmetrically, one on each side of said positive x axis.

7. A slotline microwave filter as defined in claim 6, further comprising a y axis slot disposed parallel to and coincident with said y axis.

8. A tunable slotline microwave filter comprising:

a base layer of low-loss insulating material;

a conductive magnetic material layer having a magnetic susceptibility value high enough to be classified as ferromagnetic disposed on the base layer, said conductive layer having first, second, third and fourth sides, a top surface, a positive x axis and a parallel negative x axis intersecting at an origin and dividing the top surface into halfs, said x axes running parallel to said first and third sides, and a y axis perpendicular to said x axes and intersecting therewith at said origin;

a pattern of slots formed in said conductive magnetic material layer comprising a first set of slots and a second set of slots, with said first set of slots extending parallel to said negative x axis and only extending up to but not touching said y axis, with said first and second sets of slots being symmetric about said x axes;

a dielectric junction formed at the origin of the negative and positive x axes;

first and second electrical connectors disposed opposite each other along the x axes of the conductive magnetic material layer;

means for applying a variable dc magnetic field along the surface of the conductive magnetic material layer at different desired angles, said applying means being disposed along the first and third sides of the conductive magnetic material layer to tune a resonant frequency; and a y axis slot disposed parallel to and coincident with said y axis, wherein said first set of slots comprises a first slot disposed coincident with said negative x axis, wherein said second set of slots comprises a first and second slots disposed symmetrically, one on each side of said positive x axis.

9. A tunable slotline microwave filter comprising:

a base layer of a ferrite material;

a metal material layer disposed on the base layer, said metal material layer having first, second, third and fourth sides, a top surface, a positive x axis and a negative x axis intersecting therewith at an origin and dividing the top surface into halfs, said x axes running parallel to said first and third sides;

a pattern of slots formed in said metal material layer comprising a first set of slots and a second set of slots, with said first set of slots extending parallel to said negative x axis and only extending up to but not touching said y axis, with said second set of slots extending parallel to said positive x axis and only extending up to but not touching said y axis, and with said first and second sets of slots being synmetric about said x axes;

a dielectric junction formed at the origin of the negative and positive x axes;

first and second electrical connectors disposed opposite each other along the x axes of the metal material layer for coupling electromagnetic energy to and from the metal material layer; and means for applying a variable dc magnetic field along the surface of the metal material layer at different desired angles disposed along the first and third sides of the conductive magnetic material layer to tune a resonant frequency.

10. A slotline microwave filter as defined in claim 9, wherein said means for applying a variable d.c. magnetic field along the surface of said magnetic material layer at different desired angles is a pair of orthogonal Helmholtz coils.

11. A slot line microwave filter as defined in claim 9, wherein the ferrite layer material is chosen from the group consisting of spinel, garnet and hexagonal ferrites.

12. A slotline microwave filter as defined in claim 11, wherein said first set of slots comprises a first slot disposed coincident with said negative x axis.

13. A slotline microwave filter as defined in claim 12, wherein said second set of slots comprises a second slot disposed coincident with said positive x axis.

14. A slotline microwave filter as defined in claim 12, wherein said second set of slots comprises a first and second slots disposed symmetrically, one on each side of said positive x axis.

15. A slotline microwave filter as defined in claim 14, further comprising a y axis slot disposed parallel to and coincident with said y axis.

* * * * *